US005606965A

United States Patent [19]

Panz et al.

[11] Patent Number: 5,606,965

[45] Date of Patent: Mar. 4, 1997

[54] SUBMERGED COMBUSTION SYSTEM

[76] Inventors: Eric Panz, 4715 Willow Creek, West Vancouver, Canada, V7W 1C3; Steven E. Panz, 3364 Fairmount Drive, North Vancouver, Canada, V7R 2W6

[21] Appl. No.: 215,600

[22] Filed: Mar. 22, 1994

[51] Int. Cl.[6] ..... F24H 1/20

[52] U.S. Cl. ..... 126/360 A; 126/368; 122/31.2

[58] Field of Search ..... 126/366, 367, 126/368, 360 R, 360 A; 261/124, 36.1; 122/31 A, 31 R, 31.1, 31.2

[56] References Cited

U.S. PATENT DOCUMENTS

| | | | |
|---|---|---|---|
| 3,138,150 | 6/1964 | Hyer et al. | 126/360 A |
| 3,620,571 | 11/1971 | Billings | 126/360 R X |
| 3,756,221 | 9/1973 | Patycola | 126/360 R |
| 4,530,347 | 7/1985 | Baker et al. | 126/360 R |
| 4,570,612 | 2/1986 | Ripka et al. | 126/360 A |

*Primary Examiner*—Carl D. Price

*Attorney, Agent, or Firm*—Oyen Wiggs Green & Mutala

[57] ABSTRACT

This invention relates to a novel submerged combustion system. More particularly, this invention relates to a novel submerged combustion system which can be installed singly or in combination with other similar submerged combustion systems to heat large quantities of liquids and solutions. The invention is directed to a method of regulating hydrostatic pressure in a fluid through which hot gas is being passed, and the fluid is heated by heat from the hot gas, comprising: (a) means for sensing temperature of the hot gas after it is passed through the fluid; (b) means for sensing the temperature of the fluid after it has been heated by the hot gas; (c) computer means programmed for comparing the temperature of the hot gas and the temperature of the hot fluid; (d) means for adjusting the distance the hot gas travels through the hot fluid, said means being regulated by said computer means.

28 Claims, 12 Drawing Sheets

SUBMERGED COMBUSTION SYSTEM

FIELD OF THE INVENTION

This invention relates to a novel submerged combustion system. More particularly, this invention relates to a novel submerged combustion system which can be installed singly or in combination with other similar submerged combustion systems to heat large quantities of liquids and solutions.

BACKGROUND OF THE INVENTION

Submerged combustion is a method of heating whereby hot products of combustion are forced through a solution to heat the solution. The heat exchange occurs directly between the hot products of combustion and the solution. In a submerged combustion system, the hot combustion products are generated by a flame which is typically fed by a combination of air and natural gas. The flame does not come into contact with the solution. This technology differs from conventional heat exchange methods such as immersion tube heating where the heat exchange is indirect and the products of combustion are exhausted directly to the atmosphere, rather than being forced through the solution. Submerged combustion can be utilized to heat liquids with overall system efficiency greater than 90%. Conventional hot water boiler heating systems have an efficiency of about 80% while immersion tube systems have an efficiency of about 70%.

In applications where separation of components by distillation or absorption is required, submerged combustion can be applied to provide liquid temperatures up to about 195° F.

In addition to high efficiency, submerged combustion systems are advantageous because they maintain a uniform temperature throughout the solution in which the submerged combustion is conducted. The hot combustion products keep the solution in constant agitation. Submerged combustion systems are also suitable for heating contaminated liquids. Expenses are usually lower because the submerged combustion can be conducted in a tank which need not be pressurized. Unlike boiler heating applications, a certified operating engineer is not required to operate a submerged combustion system.

Typical industrial applications for submerged combustion systems include: (a) natural gas processing plants—effluent pond heating; (b) municipal effluent holding and treatment ponds—maintenance of pond temperatures to ensure continuous high level of biological degradation especially in regions that experience extreme seasonal temperature changes; (c) aggregate wash plants heating aggregate wash water at concrete batch plants; (d) log ponds and conditioning chests—heating log ponds and conditioning vats in plywood, veneer, orientated strand board (OSB), waferboard, chopstick plants; (e) pulp and paper—mill water intake protection against freezing, white water solution heating; (f) heap leach mining—heating of barren solutions for ore extraction in heap leaching operations; (g) wet potash mining—heating of barren brine solution to maximize solubility and recovery of potash in flooded potash mines; (h) coal thawing for conveying; (i) carpet and fabric manufacturing—heating of bulk carpet and fabric dyes; (j) cogeneration—evaporation of waste water to recover water treatment chemicals in plants with zero effluent discharge; and (k) industrial processes—processes requiring large volumes of hot water or non-flammable liquids, or processes requiring a direct source of heat for distillation or absorption.

Typical commercial applications for submerged combustion systems include: (a) swimming pool heating—institutional and residential; (b) fish hatcheries—fresh water heating; (c) commercial laundries—wash water heating; (d) automotive car washes; (e) snow disposal; and (f) food processing plants.

SUMMARY OF THE INVENTION

The invention is directed to a method of regulating hydrostatic pressure in a fluid and a distance in the fluid through which hot gas is being passed, and the fluid is heated by heat from the hot gas, comprising: (a) means for sensing temperature of the hot gas after the hot gas has passed through the fluid; (b) means for sensing the temperature of the fluid after the fluid has been heated by the hot gas; (c) computer means programmed for comparing the temperature of the hot gas and the temperature of the hot fluid; (d) means for adjusting the distance the hot gas travels through the hot fluid, said means being regulated by said computer means.

In the method, the fluid can be passed through a retaining means and hot fluid can be withdrawn from the retaining means by a pumping means. The fluid occupies a volume in the retaining means which increases as fluid level rises. The hot gas can be passed through the fluid in the retaining means and the hot gas can be exhausted from the retaining means by an exhaust means. The hot gas can pass through the fluid and the distance the hot gas travels through the fluid can be proportional to the volume of the fluid in the retaining means. In the method, the means for adjusting the volume of the fluid in the retaining means can be a valve, the fluid being withdrawn by the pumping means being divided by the valve means, and the valve means, when open, recycling some volume of the fluid withdrawn by the pump means to the retaining means to adjust the volume of fluid in the retaining means. The hot gas can pass vertically through the fluid in the retaining means and the fluid level in the retaining means can be regulated by the proportion of fluid which is recycled to the retaining means by the valve means.

In the method, the computer means can be bias programmed to equalize the temperature of the fluid being withdrawn from the retaining means and the temperature of the hot gas being exhausted from the retaining means. The hot gas being passed through the fluid in the retaining means can be created by combustion of natural gas and air to create a hot combustion gas, the natural gas and air being burned in a vessel which is partially submerged in the fluid in the retaining means, the hot combustion gases exiting from the vessel in the retaining means through one or more ports in the vessel, below the surface level of the fluid level in the retaining means.

In the method, cold fluid can be delivered to the retaining means and heated by the hot combustion gas before being withdrawn at a higher temperature from the retaining means by the pumping means. The hot gas can be generated in a combustion chamber and the hot gas can pass into the fluid in the retaining means through a port in the combustion chamber. The combustion chamber can have a second port which is at an elevation which is lower than the first port. The combustion chamber can have a third port which is at an elevation which is lower than the first and second ports.

In the method, there can be a plurality of first ports, a plurality of second ports, and a plurality of third ports; the plurality of first ports each being at a first elevation, the plurality of second ports each being at a second elevation lower than the first elevation, and the plurality of third ports each being at a third elevation lower than the elevation of the second ports and the elevation of the first ports.

The invention also includes a submerged combustion system which can comprise: (a) a tank means adapted to hold liquid, the tank means having a liquid inlet and a liquid outlet, and an exhaust gas outlet; (b) combustion chamber means positioned in at least a portion of the interior of the tank means; (c) means in the combustion chamber for enabling fuel and air to be introduced into the combustion chamber and being ignited to create a hot gaseous combustion product; (d) port means located in the combustion chamber means for enabling hot combustion gases to be passed from the interior of the combustion chamber into the tank means below the level of liquid in the tank means; (e) means for controlling the level of liquid in the tank means so that hot liquid heated by the hot gaseous combustion product is withdrawn from the tank means, and cold liquid is introduced into the tank means through the liquid intake.

In the system, a weir can be used to set and maintain a fixed height minimum operating level for the liquid retained in the tank means. The tank means can be a first cylindrical vessel, and the combustion chamber can be a second cylindrical vessel which can have a diameter less than the diameter of the first cylindrical vessel, and the axis of the second cylindrical vessel can be parallel to the axis of the first cylindrical vessel. The liquid level in the tank means can be maintained at a level above the bottom of the tank means but below the top of the tank means and the portion of the combustion chamber which extends above the level of the liquid can be cooled by a cooling fluid which can be introduced into a cooling chamber encircling the top region of the combustion chamber, and can spill over the top outer edges of the cooling chamber and run down the outer walls of the cooling chamber and combustion chamber until the cooling fluid reaches the top level of the liquid being heated.

In the system, the cooling fluid can be introduced into the cooling chamber by a pipe which can cause the cooling fluid to circulate in a vortex pattern around the top of the cooling chamber. The elevation of the exterior side of the cooling chamber can be adjusted relative to the elevation of the combustion chamber. Nozzle means for combining fuel and air for combustion can be positioned in the top interior of the combustion chamber. The combustion chamber can have an inverted conical bottom.

In the system, a base of the combustion chamber, above the inverted conical bottom, can have a plurality of circular ports distributed around the circumference at a first elevation, and a plurality of circular ports distributed around the circumference at a second elevation which can be higher than the first elevation. The base of the combustion chamber can distribute around the circumference a plurality of circular ports which can be located at an elevation higher than the elevation of the first ports and the second ports.

In the system, hot gaseous combustion products can be generated in the combustion chamber and the products can be emitted through the circular ports and pass upwardly through the liquid in the tank means to thereby heat the liquid in the tank means, and the hot gaseous combustion products can be exhausted from the tank means through the exhaust means gas outlet. The system can include valve means which recycles a predetermined amount of heated liquid to the tank means to thereby regulate the level of liquid in the tank means, according to relative temperatures of the heated liquid and the exhaust combustion gases.

The system can also include computer means which senses the temperature of the exhaust gases, and the temperature of the hot liquid being withdrawn from the tank means, and prompts the valve means to open when the temperature of the exhaust gases is higher than the temperature of the hot liquid being withdrawn from the tank means, and prompts the valve means to close when the temperature of the hot liquid being withdrawn exceeds the temperature of the exhaust gases. The system can further include thermocouple means for measuring the temperature of the exhaust gas and thermo-couple means for sensing the temperature of the hot liquid being withdrawn from the tank means and a transducer which controls the valve means.

DRAWINGS

In drawings which illustrate specific embodiments of the invention but which should not be construed as limiting or restricting the spirit or scope of the invention in any way:

DETAILED DESCRIPTION OF SPECIFIC EMBODIMENTS OF THE INVENTION

Figure 1:
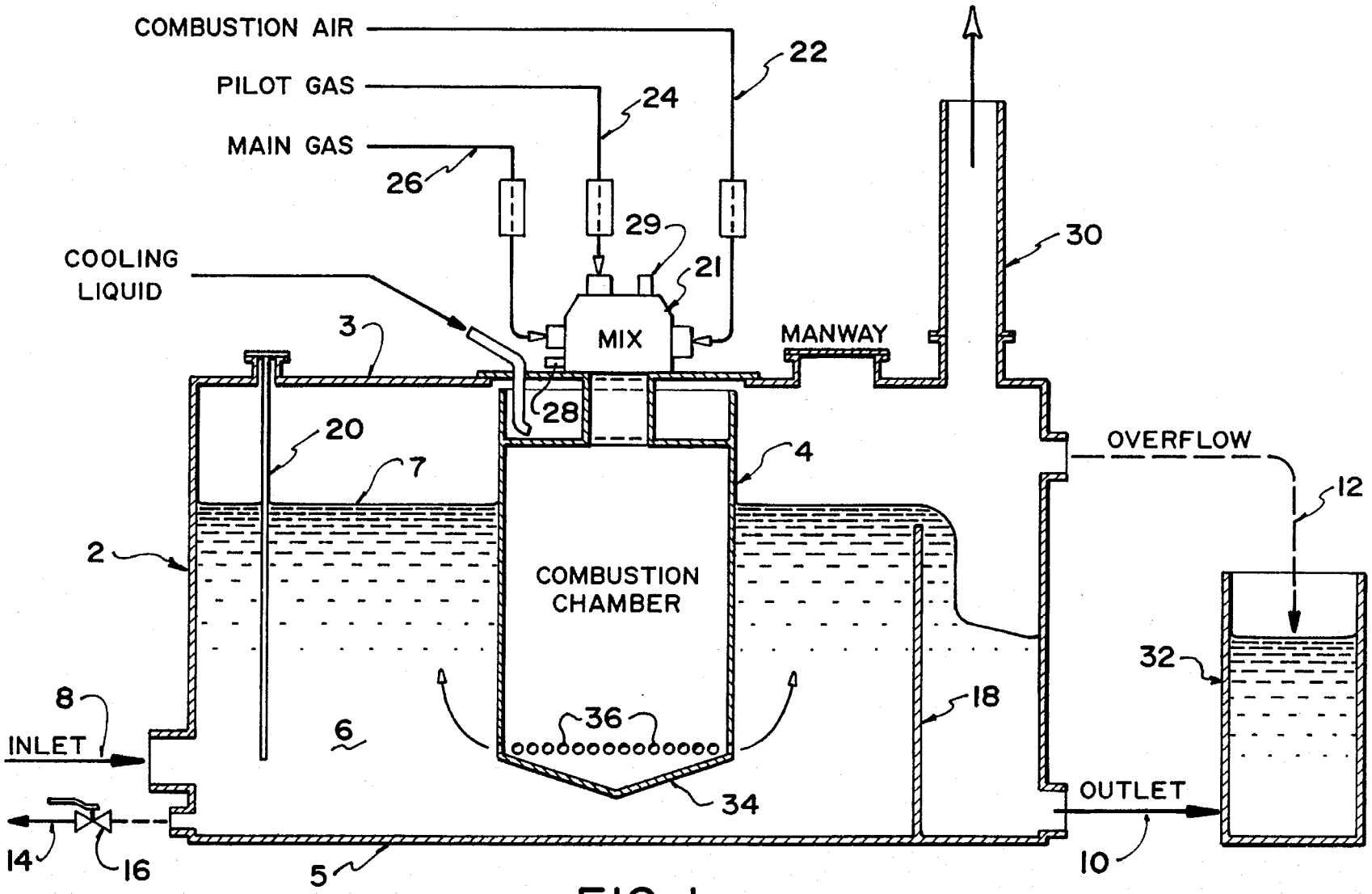
FIG. 1 illustrates a schematic side view of a submerged combustion system.

Referring to FIG. 1, which illustrates a schematic side partial section view of a submerged combustion system, the system comprises a liquid holding tank 2 which has a flat top 3 and flat bottom 5. In most cases, the tank 2 has a basic cylindrical construction. Extending downwardly in the central area of the tank 2 through an opening in the top plate 3 is a narrow cylindrical hollow combustion chamber 4. The combustion chamber 4 can be removed for maintenance. The construction of this combustion chamber 4 will be discussed in detail below.

The liquid level in the liquid holding tank 2 is depicted by liquid line 7. Liquid to be heated by submerged combustion is introduced through process inlet 8, as indicated by the arrow, and exits from the interior of the liquid holding tank 2 via process outlet 10, as also indicated by an arrow. One side of the tank 2 is fitted with a process overflow outlet 12, which coincides with the maximum upper limit tolerance level of the liquid level 7. A tank drain 14 with a valve 16 is located in the lower region of one wall of the tank 2 and permits the contents of the tank to be drained from time to time.

A liquid level control weir 18 is constructed on one side of the interior of the tank 2 and encloses the process outlet 10. The weir 18 is set at a fixed height and controls the liquid level by requiring a minimum liquid level for liquid flow through the tank. Weir 18 also acts as a baffle, preventing gaseous combustion products from exiting the tank 2 via process outlet 10. The top level of the weir 18 is located below the bottom of the process overflow outlet 12, and is also usually below the liquid level 7. The overflow outlet 12 is used for emergencies. A bubble tube type liquid level sensor 20 extends downwardly from the top 3 of the tank 2 into the interior of the liquid holding tank 2 and below the liquid level. If the sensor 20 detects a predetermined unacceptable liquid level change, it will initiate burner shutdown.

Combustion air is delivered to the nozzle mix burner 21 at the top of the combustion chamber 4 by means of combustion air inlet line 22, which has a control valve. The air is delivered under pressure. Main natural gas for the nozzle mix burner 21 is delivered under pressure by a main natural gas line 26. As a general rule, 10 to 12 volumes of air are introduced per 1 volume of natural gas, in order to obtain complete and efficient combustion. A separate pilot gas line 24 is also connected to the nozzle mix burner 21. The pilot gas is used to establish a "minimum main flame". A spark type ignitor 28 extends into the interior of the nozzle mix burner 21 and is used to ignite the pilot gas flame. An electronic flame scanner or flame rod 29 detects the presence of the minimum and also a main flame. After the minimum main flame is detected by the scanner 29, the combustion air delivered through line 22 and main natural gas delivered through line 26, are mixed and injected through the nozzle burner 21, to thereby produce a large vertical "main flame" which burns in the interior of the combustion chamber 4.

Hot gaseous combustion products for heating the liquid are created by burning the combustion air and main natural gas in the interior of the combustion chamber 4. These hot gaseous products of combustion are expelled from the interior of the combustion chamber 4 through ports 36 located in the bottom region of the combustion chamber 4, and are expelled horizontally through the liquid 6. After discharge through the ports 36, the hot products of combustion are in the form of a multitude of very hot gas bubbles (approximately 3000° F.) with very low density. These bubbles in total have a vast surface area. The bubbles rapidly shrink under the hydrostatic head of the liquid 6 and due to cooling as they rise in the liquid, and energy is exchanged into the liquid 6 to thereby heat the liquid while at the same time cooling the bubbles. After the hot gaseous products of combustion have passed upwardly through the liquid 6, as a dispersion of tiny bubbles, they are exhausted from the interior of the tank 2 through exhaust outlet 30 at the top of the tank 2, as indicated by the arrow. When operating efficiently, all of the surplus heat in the gases will have been extracted and the temperature of the exhaust gas 30 will be about the same as the temperature of the liquid 6 exiting tank 2 at process outlet 10. From process outlet 10, the heated liquid 6 is discharged into a liquid seal tank 32 to prevent hot gases exiting to atmosphere except through the exhaust 30.

Figure 2:
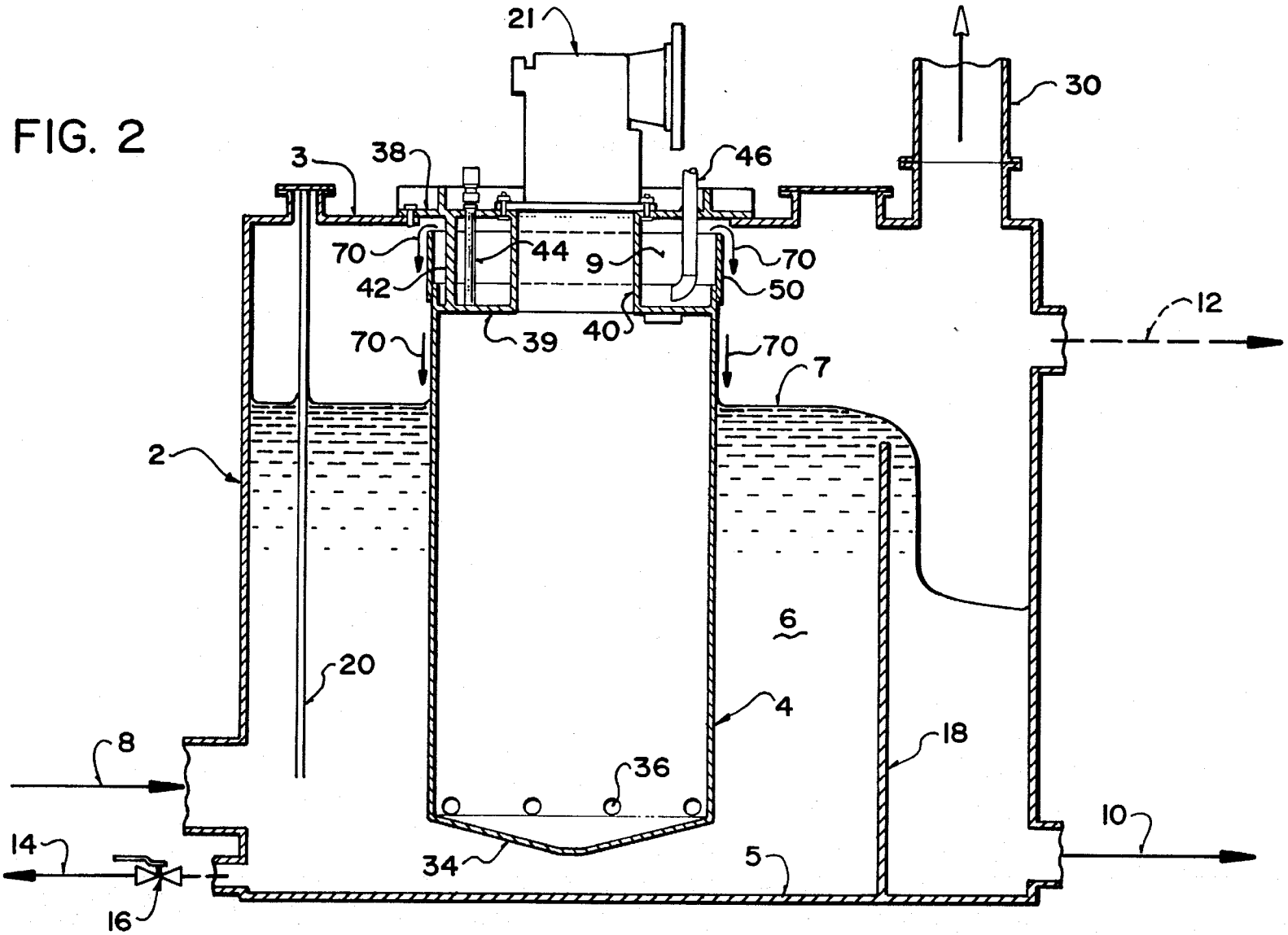
FIG. 2 illustrates an elevation section view of a submerged combustion system tank with a submerged combustion chamber installed in the interior thereof.

FIG. 2 illustrates an elevation section view of a submerged combustion system tank 2 with a partially submerged combustion chamber 4 in the interior thereof. The dimensions of the tank 2 and the dimensions of the combustion chamber 4 are sized so that maximum solution heating efficiency is obtained. The diameter of the tank 2 is approximately 3.5 times the diameter of the combustion chamber 4. We have found that this ratio minimizes metal requirements while at the same time maximizing heat transfer, liquid heating, and hot liquid circulation. There are no liquid "dead spots". FIG. 2 illustrates a number of circular ports 36 at the bottom of the sides of the chamber 4. These ports 36 dispell the hot combustion products into the liquid in the form of tiny bubbles. The burner nozzle housing 21 is positioned at the top of the combustion chamber 4, and connects with sleeve 40. The lower end of liquid level sensor 20 is submerged in the liquid 6 as indicated by dotted liquid level line 7. FIG. 2 illustrates some of the detail of the construction of the top and bottom of the combustion chamber 4. These details will be discussed more fully below. In FIG. 2, the cooling water which flows from the cooling chamber 9 down the upper outer walls of chamber 4 on all sides is indicated by arrows 70.

Figure 3:
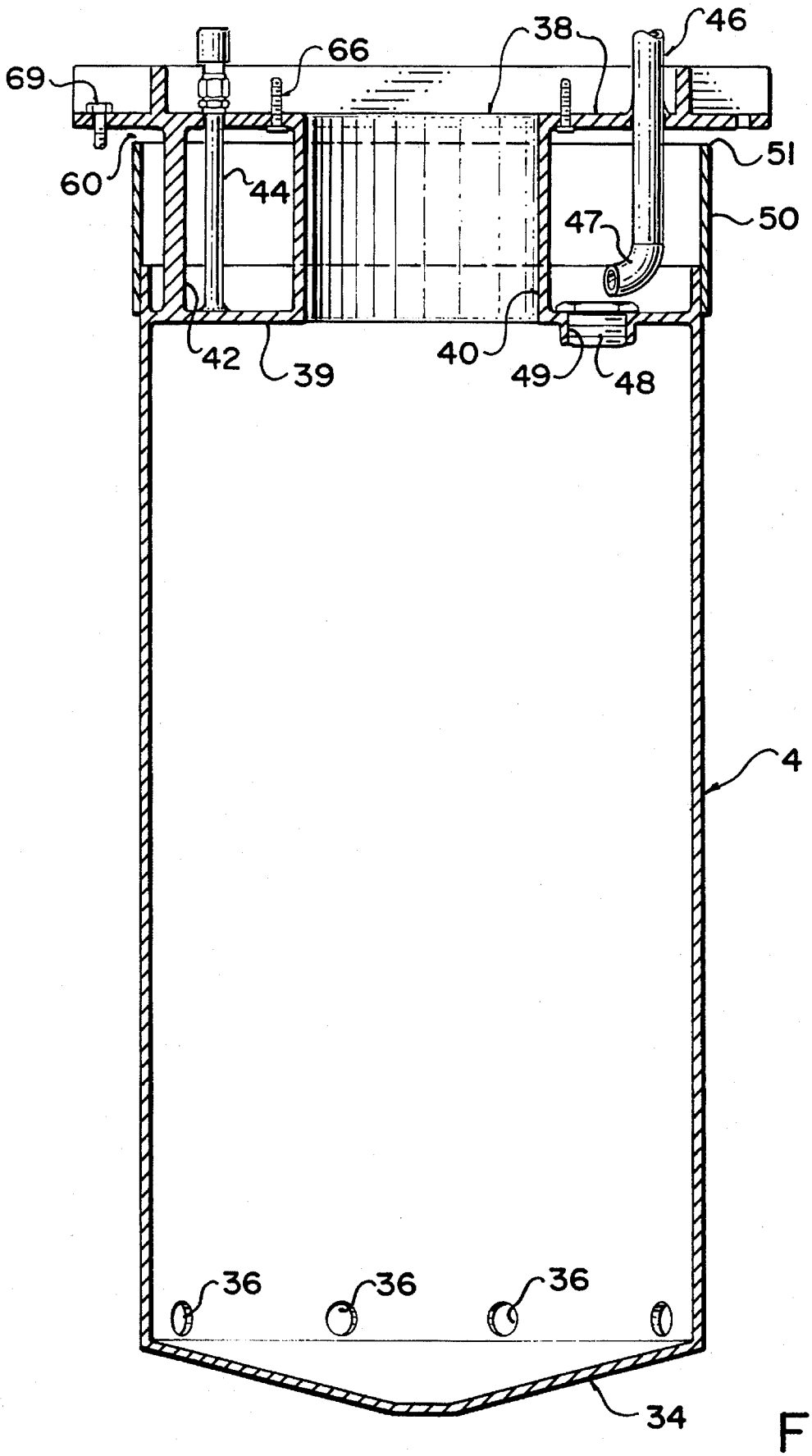
FIG. 3 illustrates an enlarged elevation section view of a combustion chamber.

FIG. 3 illustrates a side section view of a combustion chamber 4 which is depicted in general in FIG. 1 as combustion chamber 4. As shown, the height of the combustion chamber 4 is approximately three times its horizontal diameter. These dimensions coordinate with the dimensions of the tank 2 (not shown) and permit rapid gas-air mixing and an efficient combustion flame (not shown) to emit downwardly from the top of the chamber 4 without touching the interior walls of the chamber 4 or the liquid. It is important that the flame does not touch the cold walls or the liquid during operation because this reduces efficiency, leads to corrosion problems, and could "cold shock" extinguish the flame. Typically, the flame will be at about 3000° F. while the solution being heated will be between about 70° F. to about 160° F. The combustion chamber 4 is constructed in the shape of a hollow cylinder and has an inverted conical plate 34 welded or bolted to the bottom of the chamber. A series of gas combustion products exit ports 36 are formed around the circumference of the base of the combustion chamber 4, and will be discussed in greater detail below.

The top portion of the combustion chamber has a flat top plate 38 welded to the burner sleeve 40, which in turn is welded to the roof 39 of the combustion chamber 4. The periphery of the roof 39 is welded to the interior of the cylindrical side walls of the combustion chamber 4.

The volume space defined by the top plate 38, the exterior of the cylindrical burner sleeve 40 and the roof 39 is enclosed by a cylindrical adjustable elevation girdle 50 which is fitted to the exterior of the top end of the exterior walls of the combustion chamber 4. The girdle 50 in combination with the top plate 38, roof 39 and sleeve 40 define a "doughnut-like" annular hollow space cooling chamber 9, through which the cooling water is circulated.

The top plate 38 and the roof 39 of the combustion chamber 4 have a series of vertical support rods 42 welded to the underside of top plate 38 and the top of roof 39 of the combustion chamber 4, to prevent the development of adverse bending moments, which might be created by the long combustion chamber and bubble eruptions through the ports 36. A thermo-couple assembly 44 with the thermocouple making contact with the roof 39 of combustion chamber 4 senses temperature and provides protection against overheating. A pipe and elbow unit 46 is constructed in the interior of the "doughnut" cooling chamber 9, and serves to introduce cooling fluid in a tangential direction within the hollow interior of the "doughnut". This cooling fluid, by means of tangential introduction, slowly swirls in a vortex pattern around the interior of the cooling chamber 9 and spills over the top lip 51 of the girdle 50 and down the outsides of the combustion chamber 4 and ultimately into the liquid 6 confined in the interior of the tank 2 (see FIG. 1).

When the system is in a dynamic state, the level of the liquid 6 extends part way up the exterior walls of the chamber 4. The exposed walls of combustion chamber 4 above the surface level of liquid 6 must be cooled so that extreme temperature differences are avoided. If there were no cooling water spilling over the outsides of the upper walls, the internal flame at 3000° F. would heat the exposed walls of the chamber 4 above the liquid 6 to destructive melt temperatures, while the bottom submerged portion of the walls would remain at the temperature of the liquid which is typically about 70° F. to 160° F.

Figure 4:
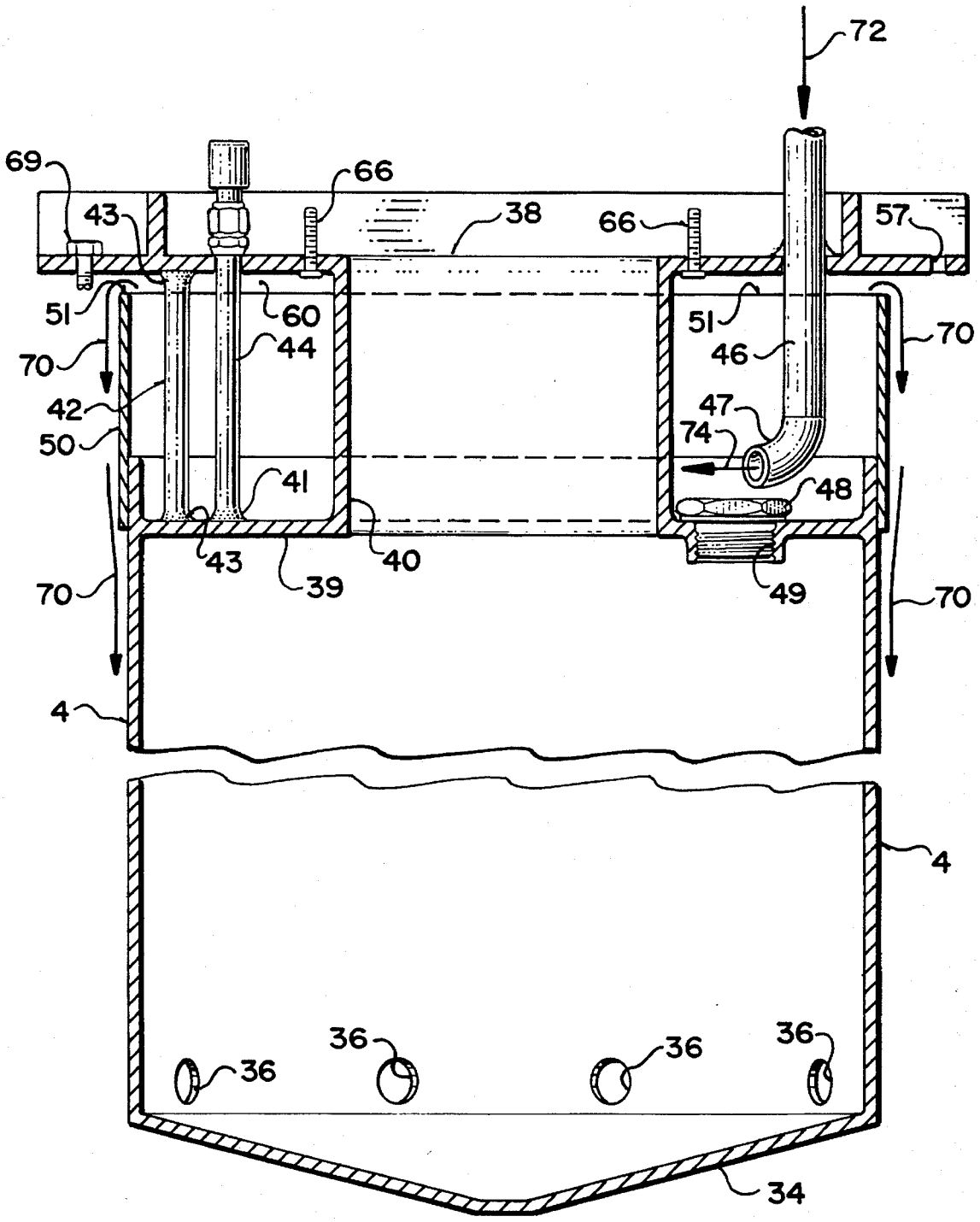
FIG. 4 illustrates a truncated elevation section view of the top and bottom parts of a combustion chamber.

FIG. 4 illustrates a truncated section view of the bottom and top portions of a combustion chamber 4. The inverted conical shape of the bottom 34 is a unique feature of the submerged combustion system. It is constructed so that steam bubbles which collect on the outside of the conical bottom 34 are encouraged to migrate upwardly and radially outwardly along the bottom surface of conical bottom 34. The bubbles then do not collect on the bottom surface of the conical bottom 34. Such bubbles, if they remain in position, would permit overheating and oxidizing of the bottom of the combustion chamber 4. Prior constructions of combustion chambers have had flat bottoms, or recessed bottoms, which are easy and inexpensive to manufacture. However, flat bottom combustion chambers have been known to oxidize in relatively short order and have had to be replaced on a frequent basis. The inverted conical design of the bottom 34 of the applicant's design is a unique feature and greatly prolongs the life of the combustion chamber 4. Gas bubbles are discouraged by the inverted conical design from collecting on the bottom surface of the chamber bottom 34, and overheating and subsequent oxidation is minimized.

The construction of the cooling chamber 9 formed by the sleeve 40, top plate 38, roof 39 and girdle 50, is shown in more detail in FIG. 4. The cooling chamber 9 contains cooling fluid which cools the burner sleeve 40 and roof 39 of the top end of the combustion chamber 4. The cooling fluid also spills over the exterior surface of the upper walls of the combustion chamber 4, above liquid level 7. The design of the "doughnut" is a unique feature associated with the combustion chamber 4 of the invention. The vertical thermo-couple 44 is welded in place to roof 39 of the interior of the cooling chamber 9 by welds 41. Likewise, the plurality of vertical stabilizer rods 42 (one is shown) are located in place between the underside of the top plate 38 by welds 43 and the top of the roof 39, and tangentially to the inside of the top interior walls of the combustion chamber 4 (see FIG. 5). The cooling water in-flow pipe 46, which has at the bottom an elbow 47, which directs in-flow cooling water tangentially into the interior of the hollow "doughnut", is welded to top plate 38 by welds. A clean-out plug 48, which is accessible to an operator from the top of the chamber 4, and enables the operator to clean accumulated debris from the "doughnut", is screwed by male threads into female threaded receptacle 49, which is welded to the periphery of a hole in the roof 39. Another unique feature of the design of the cooling cooling chamber 9 is that the girdle 50 can be raised or lowered relative to the upper edge of combustion chamber 4, and top plate 38. Thus the flow of cooling water down the outer sides of the upper walls of chamber 4 can be adjusted by raising or lowering the girdle 50 and thus the amount of cooling water that spills in water-fall fashion over lip 51.

Sleeve 40 replaces the sleeve which is normally found on a commercial burner. The burner 21, with its sleeve removed, fits on the sleeve 40 and is mounted in place by bolt 66. The cooling water being introduced into pipe and elbow 47 is indicated by arrow 72. The water being introduced into the interior of the "doughnut" at a tangent is indicated by arrow 74.

Figure 5:
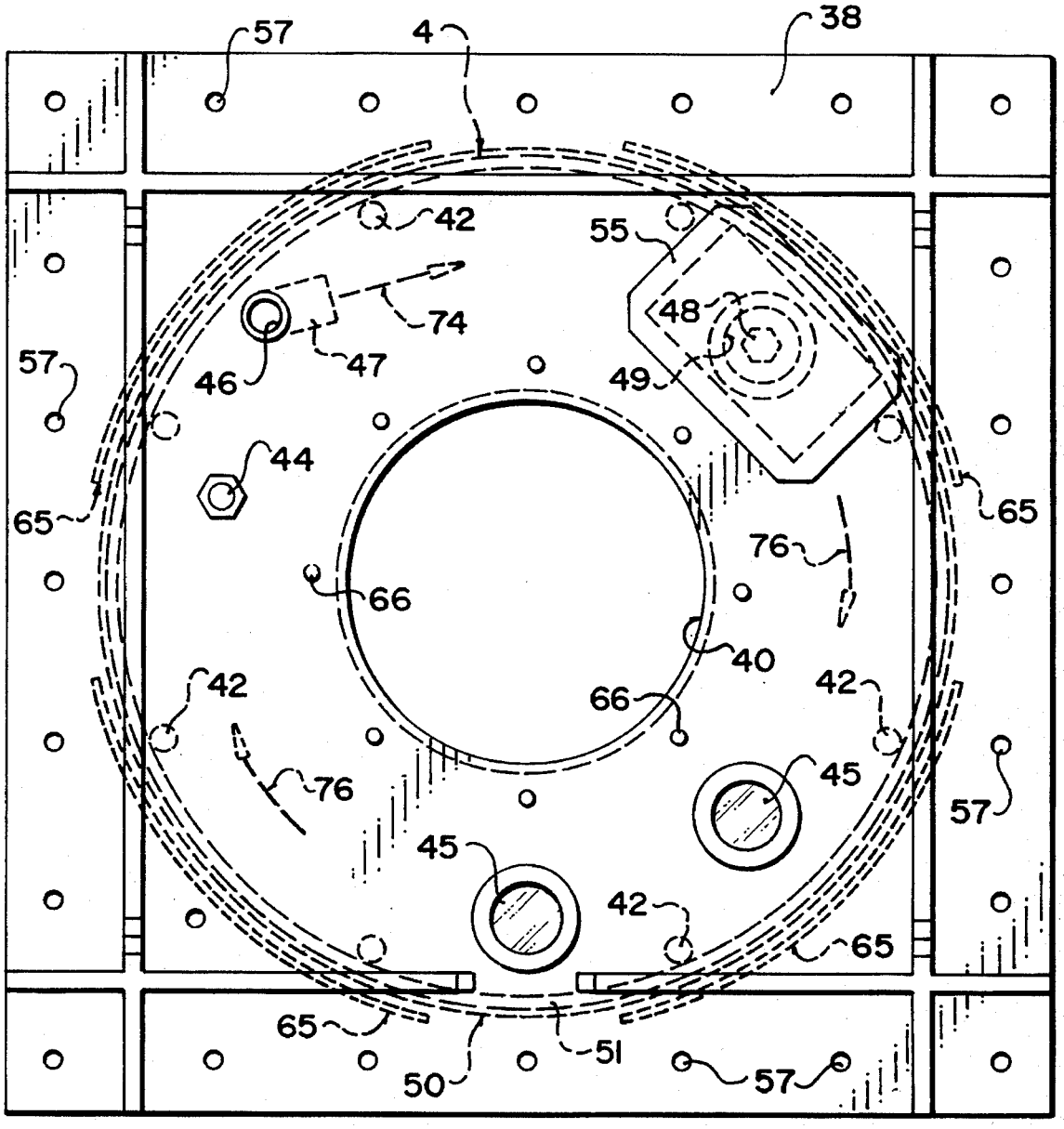
FIG. 5 illustrates a plan view of a combustion chamber.

FIG. 5 shows a top view of the combustion chamber 4 (shown in dotted lines) and the square steel top plate 38 which indirectly connects the top of the chamber 4 to the top 3 of the tank 2 (see FIGS. 1 to 4). The semi-tangential orientation of elbow 47 can be seen at the top left of the FIG. 5. Cooling water introduced through elbow 47 (indicated by arrow 74) is forced to swirl tangentially around the interior of the cooling chamber 9 (indicated by arrows 76), thereby keeping the cooling water in constant circulation, and the sleeve 40 and roof 39 of the cooling chamber 9 cool. The upper end of the burner sleeve 40 fits against the base of a standard nozzle mix burner which is located above the sleeve. A standard burner is available from Maxon Corporation Muncie, Ind. The cooling water spills over the lip 51 of the top of the girdle 50. A removable manhole-cover plate 55, which is constructed above the clean-out plug 48 and threaded coupling 49, is shown at the top right of FIG. 5. The top of thermo-couple 44 is shown at the left of the "doughnut". The vertical and inclined "peep-sights" 45 are illustrated at the bottom of FIG. 5 and permit the operator to climb up on top 3 of the tank 2 and view the interior of the chamber 4 and the flame action in the interior of the combustion chamber 4.

FIG. 5 also illustrates in dotted line configuration the circumference of the combustion chamber 4, the exterior cylindrical girdle 50 of the cooling chamber 9, which slides vertically upwardly or downwardly on combustion chamber 4 and segmental deflectors 65 (see also FIG. 6) which contain stray cooling liquid. A series of equally spaced support rods 42 are distributed around the interior of the periphery of the combustion chamber 4. The steel plate 38 is secured to the top of the tank 2 by a spaced array of bolts 69 (see FIG. 4) which pass through bolt holes 57.

Figure 6:
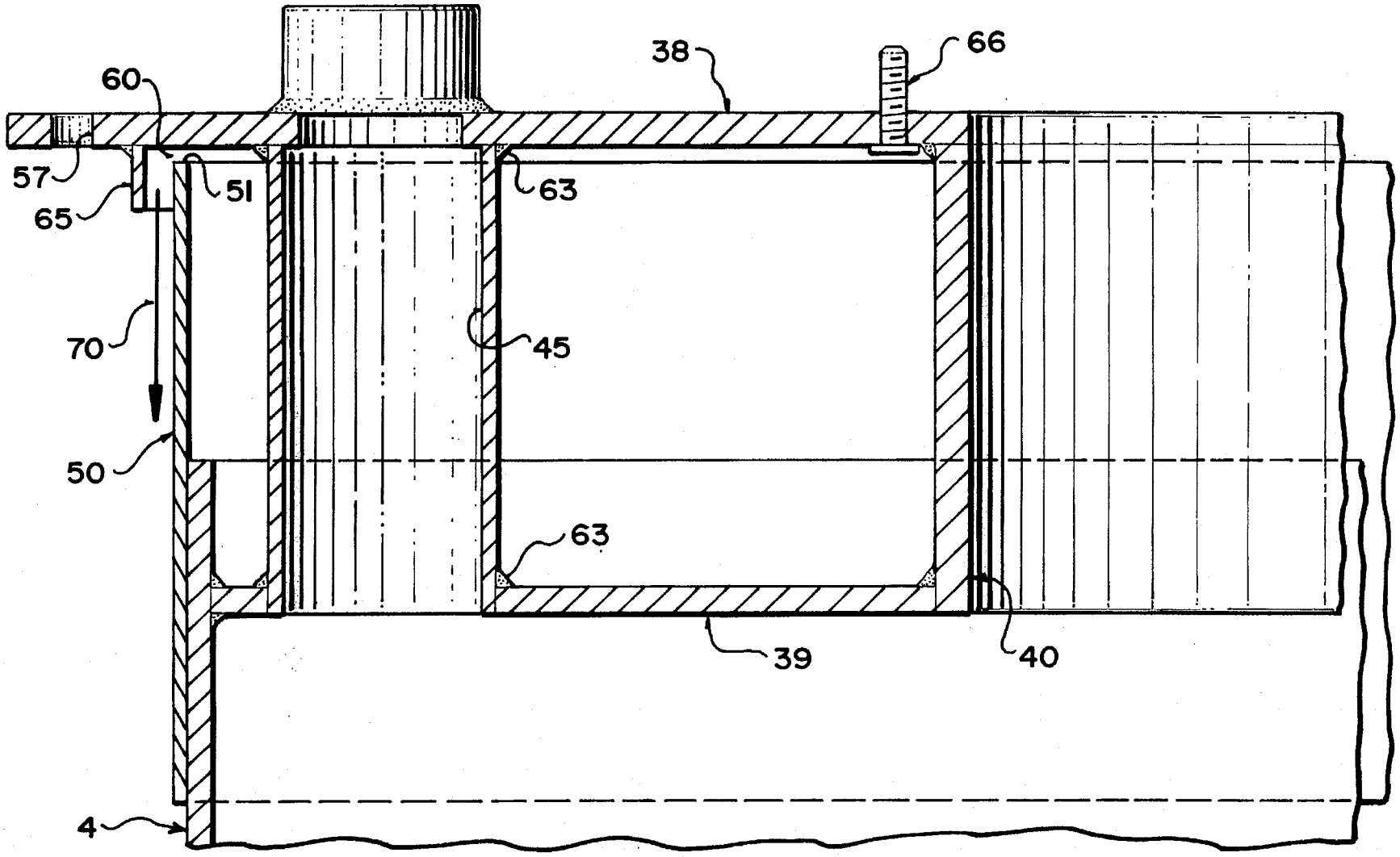
FIG. 6 illustrates a side section detail of a cooling chamber.

FIG. 6 illustrates a cross-section detail of a top left portion of the combustion chamber 4 and the cooling chamber 9. The cylindrical hollow "peep sight 45" is vertically positioned and penetrates through the interior of the cooling chamber 9 and is held in place by welds 63. As can be seen in FIG. 6, there is a small opening 60 between the top plate 38 and the top lip 51 of the girdle 50 of the cooling chamber 9. Once the girdle 50 of the "doughnut" has been adjusted to the proper elevation in association with the top edge of combustion chamber 4, and cooling water is introduced into and is circulated in the interior of the cooling chamber 9, the cooling water spills over the top lip 51 of the girdle 50 through opening 60 and flows down the outer side walls of the upper region of the combustion chamber 4. This is indicated by arrow 70. This cooling liquid provides a cooling effect on the top regions of the combustion chamber 4, which are above the liquid level 7, when the submerged combustion system is in operation. The cooling liquid keeps the temperature of the combustion chamber 4 relatively uniform throughout its height, above the liquid level 7. An outer downwardly projecting segmented deflector 65 which is of a broken ring-like configuration (see FIG. 5), is welded to the underside of the top plate 38, and surrounds the opening 60. This deflector 65 induces the cooling fluid to travel downwardly and flow down the outside wall of the girdle 50 and the upper outer regions of the combustion chamber 4. If deflector 65 were not in place, some of the tangentially flowing cooling water would project or spray outwardly and therefore would not contact the outer surface of the combustion chamber 4. The cooling effect of some of the cooling liquid would be lost if all of the liquid did not contact the outer walls. Lip 51 should be leveled around its circumference so that opening 60 is uniform throughout and cooling water in turn is uniformly distributed over the exterior upper surface walls of combustion chamber 4.

Figure 7:
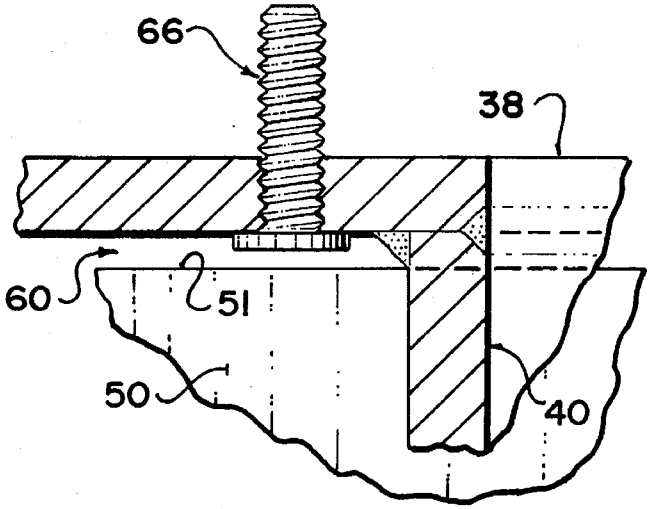
FIG. 7 illustrates an enlarged side view of the top left region of FIG. 4.

FIG. 7 illustrates a section detail of the top left part of FIG. 4 and illustrates the way in which the top region of the inner wall of the burner sleeve 40 is welded to the top plate 38 of the combustion chamber. A portion of the water gap 60 is also visible in detail shown in FIG. 7. Mounting bolt 66 for mounting the burner (not shown) in place on sleeve 40 is also shown in section.

Figure 9:
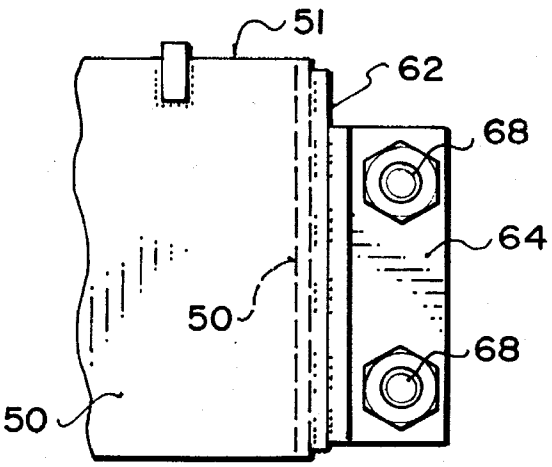
FIG. 9 illustrates a side view of a connection joint of a girdle for the top portion of a combustion chamber.
Figure 10:
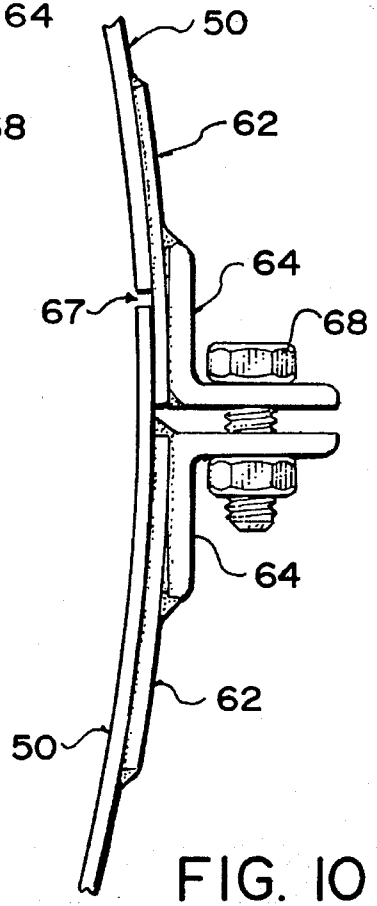
FIG. 10 illustrates a top view of a girdle and connection joint for the top portion of a combustion chamber.
Figure 8:
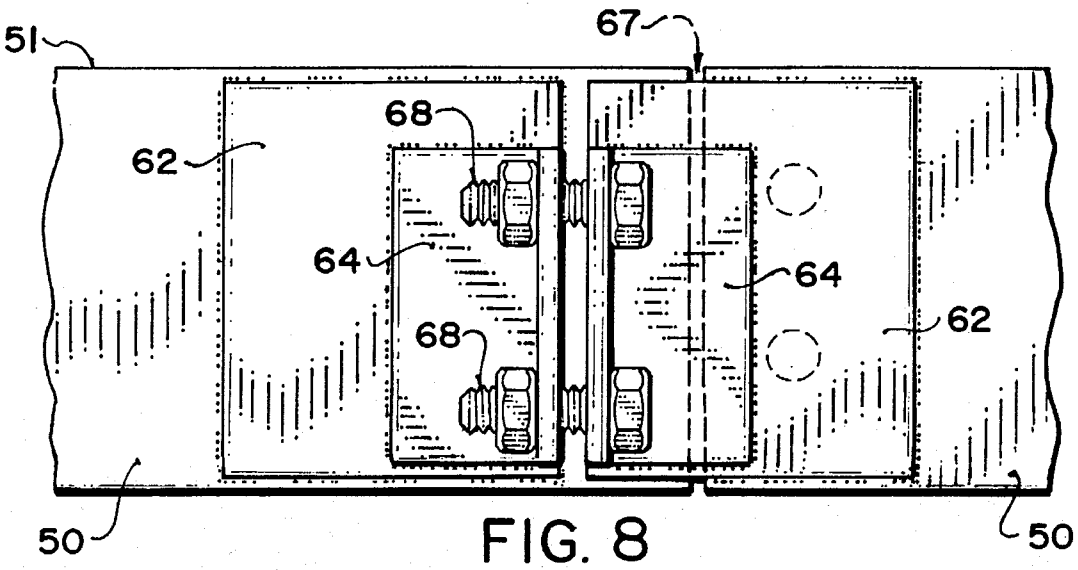
FIG. 8 illustrates a side detail of a girdle for the top portion of a combustion chamber.

FIGS. 8, 9 and 10 illustrate the securing mechanism that is used to hold the outer cylindrical girdle 50 of the cooling chamber 9, at any particular specified elevation, to adjust flow of the cooling water. The outer reinforcing bands 62 are welded to the girdle 50 and angle irons 64, which are pulled together by bolts 68. This structure enables the girdle 50 to be tightened by means of bolts 66 so that the gap becomes very small. The elevation of cylindrical girdle 50 can be adjusted relative to the top plate 38 in order to adjust the opening of gap 60, and in turn the flow of cooling water down the exterior walls of the combustion chamber 4.

Figure 11:
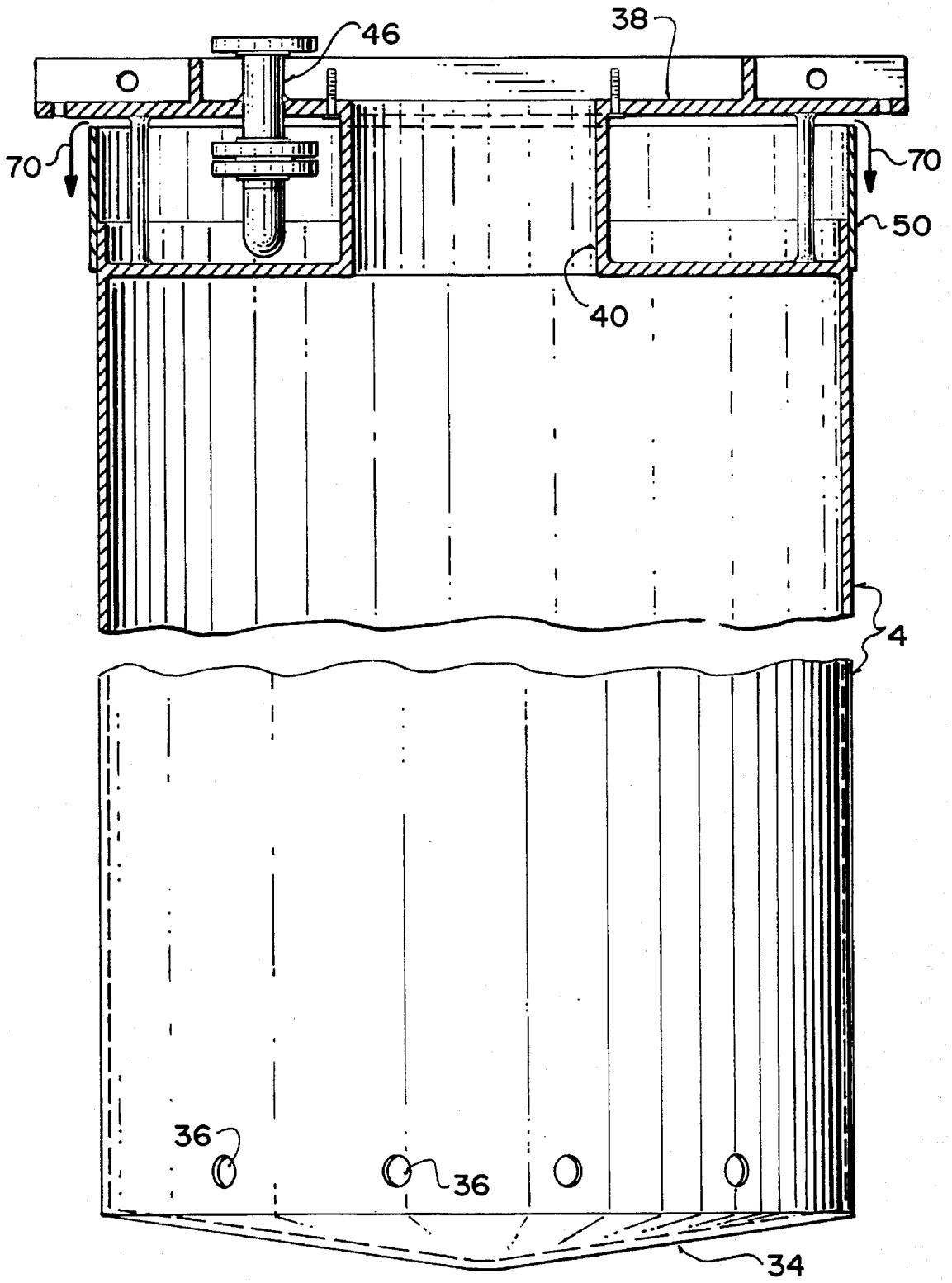
FIG. 11 illustrates a truncated side view of the top and bottom of an alternative embodiment of combustion chamber.
Figure 12:
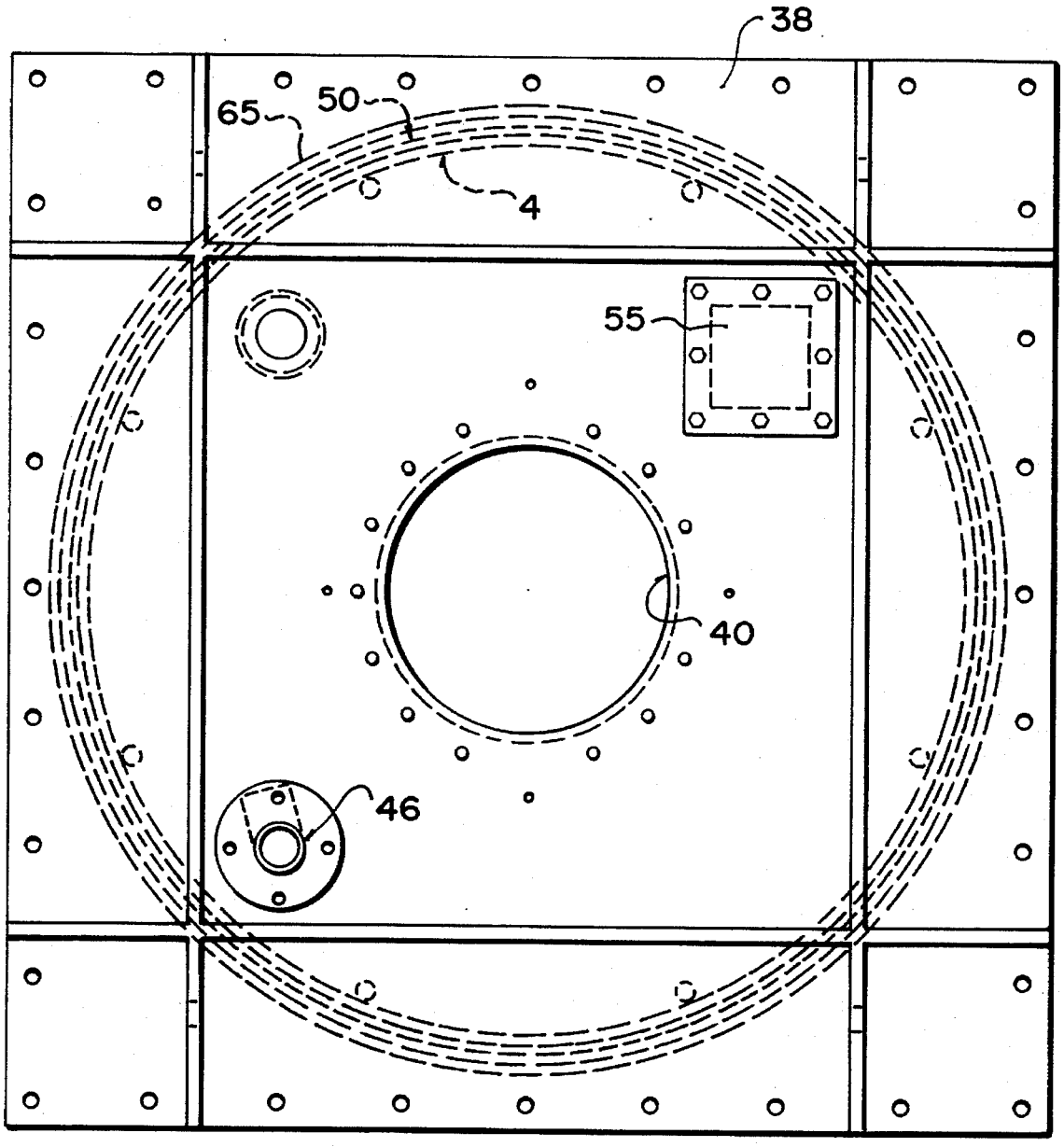
FIG. 12 illustrates a plan view of an alternative embodiment of combustion chamber.

FIG. 11 illustrates a truncated side section view of the top and bottom of an alternative embodiment of combustion chamber. FIG. 12 illustrates a plan view of the alternative embodiment of the combustion chamber. The embodiment of combustion chamber illustrated in FIGS. 11 and 12 is simpler in construction than the embodiment disclosed in the previous drawings. The base of the combustion chamber 4 has two elevations of ports 36, rather than three elevations. Also, the construction of the cooling chamber 9 for the cooling water system is simplified. However, the basic function of cooling the upper outer walls of the combustion chamber 4 is the same. Water for cooling spills over the upper lip of the cylindrical outer girdle 50.

Figure 13:
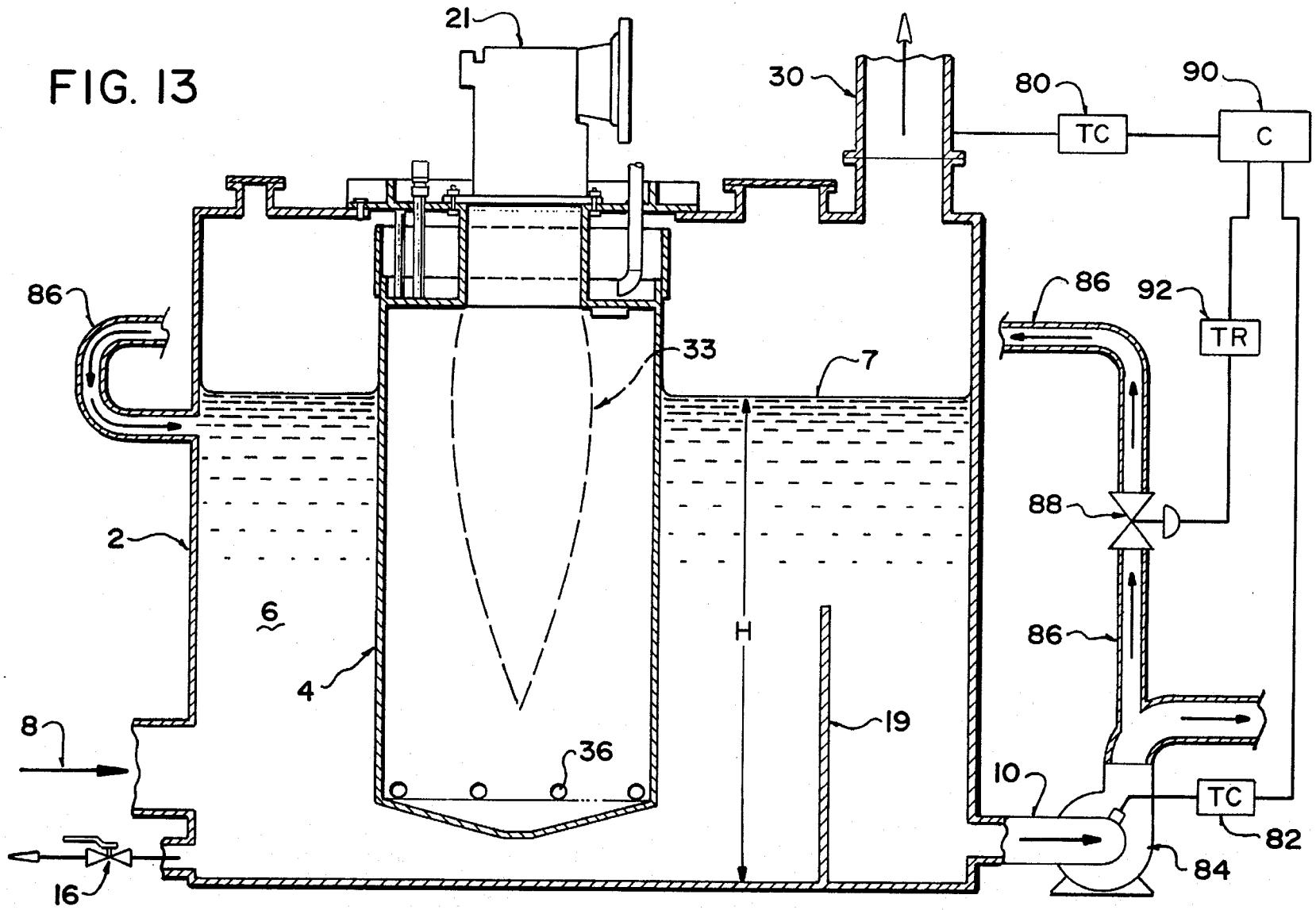
FIG. 13 illustrates a side schematic view of a submerged combustion system equipped with computer controlled partial hot solution recycling system for regulating liquid level in the tank and equalizing exhaust gas temperature and solution outlet temperature.

FIG. 13 illustrates a side schematic view of a submerged combustion system equipped with computer controlled partial hot solution recycling system for regulating liquid level in the tank 2 and maximizing heat exchange by equalizing the temperature of the exhaust gas 30 and the temperature of the solution outlet 10. As seen in FIG. 13, the liquid to be heated is introduced into the tank 2 through inlet 8. Typically, the liquid to be heated is pumped into the tank 2 by a centrifugal type self-priming pump. A typical pump is manufactured by Gorman Rupp. These pumps are able to handle liquids which contain a high degree of sediment, lumps and particles without clogging. The liquid introduced through inlet 8 is heated by combustion gases which are generated by flame 33, which extends downwardly from air-natural gas mixing nozzle 21. The hot combustion gases generated by the flame 33 egress from the interior of combustion chamber 4 through ports 36 and bubble upwardly through the tank liquid which is indicated by level 7. The hot combustion gases then exit through exhaust outlet 30 at the top of the tank 2.

The inventors have discovered that the efficiency of the heat transfer of the hot combustion gases passing through the liquid in the tank 2 can be maximized if the temperature of the heated liquid being pumped from heated outlet 10 is of the same temperature as the temperature of the hot combustion gases exiting through exhaust 30. This is a unique and inventive feature of the applicants' submerged combustion system. If the temperature of the exhaust gas exiting through exhaust 30 is higher than the temperature of the heated liquid being pumped through liquid outlet 10, then all of the transferable heat in the exhaust gas 30 has not been utilized in heating the liquid. The applicants have discovered that the maximum amount of heat in the hot combustion gas can be extracted by regulating the height of the liquid level 7 (denoted by "H" for head in FIG. 15). For example, if the temperature of the exhaust gas 30 is significantly higher than the temperature of the liquid in the outlet 10, and the height "H" of the solution is raised, then the hot combustion gases must pass through a greater head of fluid before exhausting through exhaust 30, thereby transferring more heat from the gas to the solution. Alternatively, if the head "H" is lowered, then the distance the hot combustion gases must bubble through the liquid to be heated will be less, and accordingly less heat will be exchanged from the hot combustion gases into the liquid before they are exhausted through outlet 30. The solution level 7 is adjusted by recycling a certain amount of heated liquid from outlet 10 into the tank 2 upstream of weir 18.

FIG. 13 illustrates a system which can take advantage of the applicants' unique method of maximizing transfer of heat from the hot combustion gases into the liquid to be heated. As seen in FIG. 13, a thermocouple 80 is connected to the exhaust flue 30. A suitable thermo-couple is manufactured by Honeywell Controls Inc. This thermo-couple 80 senses the temperature of the hot gases being exhausted through gas outlet 30, as indicated by the upwardly pointing arrow in gas exhaust 30. Similarly, a thermo-couple 82 is connected to the hot liquid outlet 10, which is being withdrawn by pump 84, as is indicated by the arrows in FIG. 13. As seen in FIG. 13, a recycle line 86 is connected between outlet 10 and the tank 2. Thermo-couple 82 senses the temperature of the hot liquid being withdrawn through outlet 10. Both the thermo-couple 80, connected to the gas exhaust 30, and the thermo-couple 82, connected to the hot outlet 10, are electronically connected to a programmed computer 90. Computer 90 is programmed so that it is biased to equalizing the temperature being sensed by thermo-couple 80 and the temperature being sensed by thermo-couple 82. When the temperature sensed by thermo-couple 80 is higher than the temperature being sensed by thermo-couple 82, the computer 90 will send a signal to transducer 92, which regulates the position of valve 88, in hot liquid recycle line 86. A suitable transducer 92 is manufactured by either Bailey Company or Fisher Controls.

If the temperature being sensed by thermo-couple 80 is higher than the temperature being sensed by thermocouple 82, the valve 88 will be opened slightly, thereby permitting a greater volume of heated liquid to be recycled to the interior of the tank 2 through return line 86, as indicated by the return arrows. The head "H" of the solution in tank 6 will rise accordingly until such time as the amount of heat being exchanged from the hot combustion gases into the heated liquid is increased to the point where the temperature of the exhaust gas in outlet 30 is equal to the temperature of the hot solution being withdrawn through outlet 10 by pump 84.

This unique temperature equalization system between exhaust gas and outlet liquid temperature assures maximum thermal efficiency and minimal energy consumption in both fuel and electric power consumption.

Figure 14:
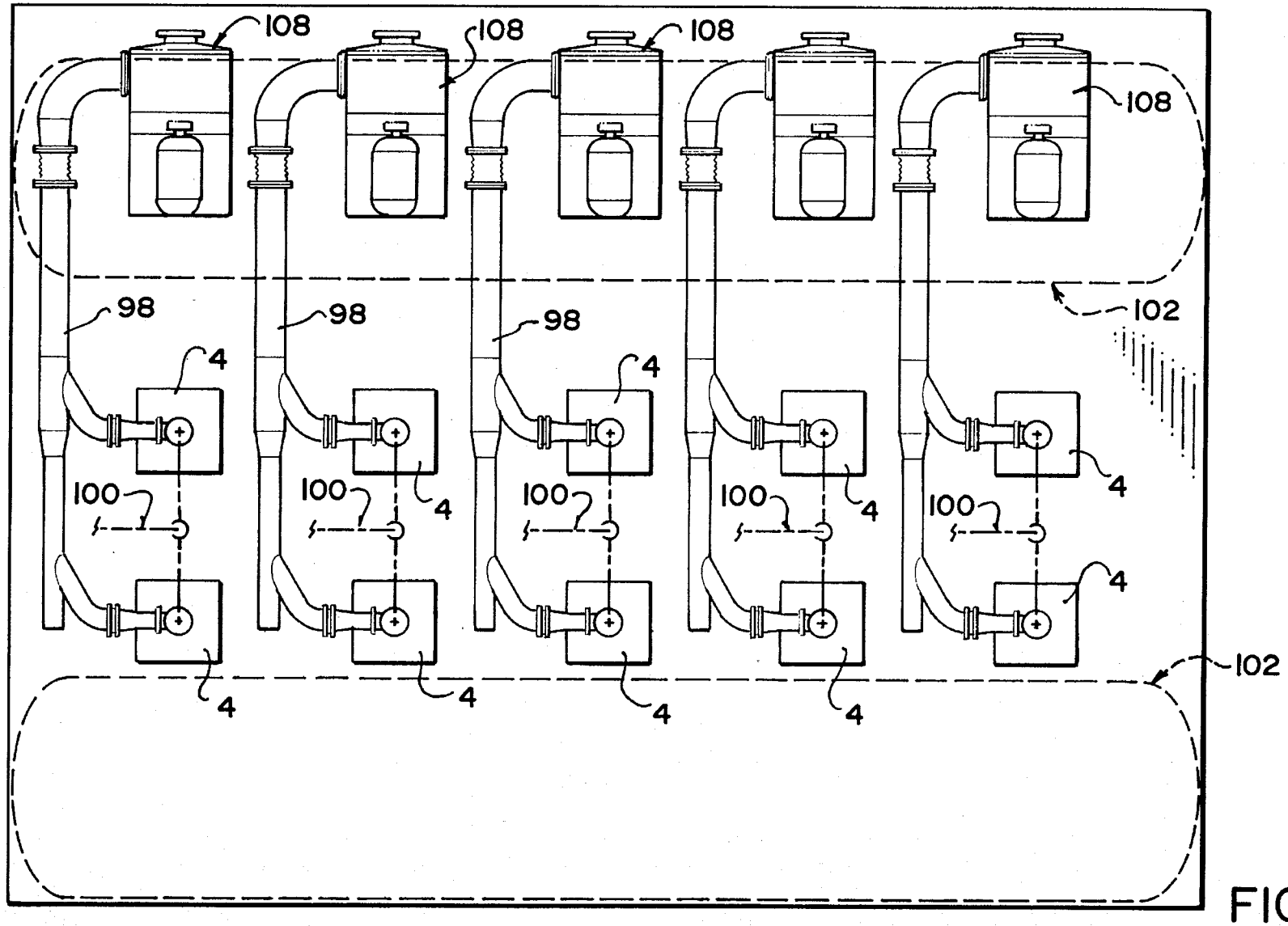
FIG. 14 illustrates a plan view of a multiple submerged combustion system installation.
Figure 15:
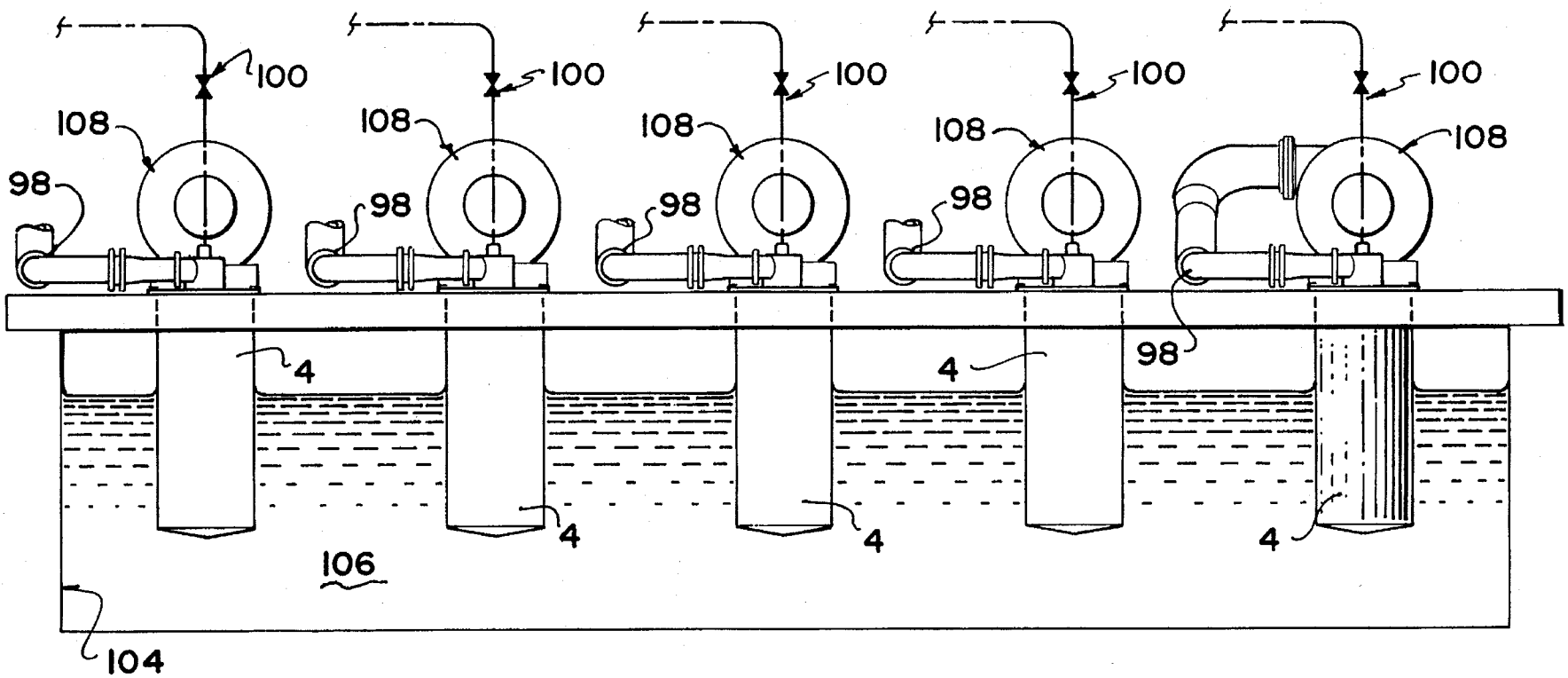
FIG. 15 illustrates a side view of a multiple submerged combustion system installation.

FIG. 14 illustrates a plan view of one version of a multiple submerged combustion system installation. FIG. 15 illustrates a side view of the same version of a multiple submerged combustion system installation. FIG. 14 illustrates a grid array of partially submerged combustion chambers 4 which are spacially arranged and connected together by common natural gas inlet lines 100, and common air conduits 98. In this way, a large quantity of liquid can be heated by a grid pattern of the submerged combustion chambers connected together. The grid of submerged combustion chambers 4 can be supported by steel framework, or, if necessary, floated on pontoons 102, which float on the pond of liquid to be heated. FIG. 15 illustrates a side view of a number of submerged combustion chambers 4 connected together in a spaced pattern, and submerged into a pit 104, which contains liquid 106, that is to be heated. The chambers 4 are serviced by blowers 108 which pump the air to the nozzle mix burners.

As an example of use, in potash mining in Saskatchewan, the potash deposits underground are continuously fed with heated brine solution in order to absorb potash, which is then brought to the surface and discharged in a brine pond at a considerable distance from the brine heating system. This allows precipitation of the potash in cold weather. Furthermore, in a tarsand (bitumen) mining system, such as the Athabasca Tarsands in Northern Alberta, Canada, hot liquids can be used to separate the bitumen from the sand. The process can include large ponds which are constructed on the tarsand deposits, and then heated and used for separation of the bitumen from the sand by treating the bitumen with the hot liquid. The heating can be done by using a grid of submerged combustion heating systems.

ADVANTAGES OF THE SUBMERGED COMBUSTION SYSTEM

The submerged combustion system has a large number of advantages over other liquid heating systems. (1) Over 90% efficiency. (2) Uniform temperatures throughout the solution in the tank due to strong solution agitation. (3) Compact design solution holding tank, depending on solution type, permits combustion tank to act as a reaction vessel, due to the strong mixing action developed. (4) The combustion tank is not pressurized and is designed so that maintenance personnel can easily enter tank and perform maintenance tasks. (5) Operation of the submerged combustion system does not require a Certified Operating Engineer. (6) Solution discharge temperature is controlled with a single feedback loop, so that expensive and troublesome controls and valves are not required. (7) Simple, safe, and reliable design provides years of trouble free service.

The submerged combustion system can be available as a standardized pre-packaged unit with heat inputs up to 20-million Btu per hour. The system capacity selected determines whether single or multiple burner units are required. Generally, single burner units are sufficient up to 10-million Btu per hour, whereas multiple burner units are required for systems generating more than 10-million Btu per hour. Field erection is required for units over 20-million Btu per hour.

The burner design selected should provide complete and efficient mixing of the fuel and combustion air. In larger applications, multiple burners can be readily installed at the top of the thank. The combustion chamber should be sized relative to the tank dimensions to ensure that relatively high velocities are obtained for proper unit operation. The submerged combustion system should be controlled with Programmable Logic Control (PLC) based flame safeguard systems. The totally automatic control system enables the system to be started with a simple "Start" button.

SUBMERGED COMBUSTION OPERATION

During system start-up, a five-second automatic pre-ignition purge evacuates liquid from the combustion chamber. The PLC-based burner management system supervises and controls all interlocks and upon proof of pilot ignition, permits main burner ignition. During operation, the heat input is controlled by sensing the temperature of the liquid at the point of discharge. The liquid level in the tank is constantly monitored and interlocked by means of an air bubble liquid level sensing system.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of regulating hydrostatic pressure in a liquid through which hot gas is being passed, and the liquid is heated by heat exchange with the hot gas, comprising:

(a) a first device for sensing temperature of the hot gas after the hot gas is passed through the liquid;

(b) a second device for sensing temperature of the liquid after the liquid has been heated by the hot gas;

(c) computer means communicating with said first device and said second device and programmed for comparing the temperature of the hot gas and the temperature of the liquid after the liquid is heated;

(d) means for adjusting distance the hot gas travels through the liquid, said distance adjustment means being regulated by said computer means.

2. A method as claimed in claim 1 wherein the liquid is passed through a retaining means and hot liquid is withdrawn from said retaining means by a pumping means.

3. A method as claimed in claim 2 wherein the hot gas is passed through the liquid in said retaining means and the hot gas is exhausted from said retaining means by an exhaust means.

4. A method as claimed in claim 3 wherein the hot gas is generated in a combustion chamber and the hot gas passes into the liquid in said retaining means through a port in said combustion chamber.

5. A method as claimed in claim 4 wherein said combustion chamber has a second port which is at a second elevation which is lower than said port claimed in claim 10, now described as a first port, which is at a first elevation.

6. A method as claimed in claim 5 wherein said combustion chamber has a third port which is at a third elevation which is lower than said first and second elevations.

7. A method as claimed in claim 6 wherein there are a plurality of said first ports, a plurality of said second ports, and a plurality of said third ports, said first ports all being at said first elevation, said second ports all being at said second elevation lower than said first elevation, and said third ports all being at said third elevation lower than said first and second elevations.

8. A method as claimed in claim 2 wherein the hot gas passes a distance through the liquid that is proportional to the volume of the liquid inside said retaining means.

9. A method as claimed in claim 8 wherein said means for adjusting said distance the hot gas travels through the liquid, is a valve, the liquid being withdrawn by said pumping means is divided by said valve means, and said valve means, when open, recycles a proportion of the liquid withdrawn by said pump means to said retaining means to adjust the volume of liquid in said retaining means.

10. A method as claimed in claim 9 wherein the hot gas passes vertically through the liquid in said retaining means and a liquid surface level in said retaining means is regulated by said proportion of the liquid which is recycled to said retaining means by said valve means.

11. A method as claimed in claim 10 wherein said computer means is bias programmed to equalize the hot gas temperature measured by said first device for sensing the gas temperature after the gas has been passed through the liquid and the liquid temperature measured by said second device for sensing liquid temperature after the liquid has been heated by the gas.

12. A method as claimed in claim 11 wherein the hot gas being passed through the liquid in said retaining means is created by combustion of natural gas and air to create the hot gas, the natural gas and air being burned in a vessel which is partially submerged in the liquid in said retaining means, the hot gas exiting from said vessel in said retaining means through one or more ports in said vessel, below said liquid surface level in said retaining means.

13. A method as claimed in claim 12 wherein the liquid is colder than the hot gas when it is delivered to said retaining means and the liquid is heated by the hot gas before being withdrawn at a higher temperature from said retaining means by said pumping means.

14. A submerged combustion system comprising:

(a) a tank means adapted to hold liquid, said tank means having a liquid inlet and a liquid outlet, and an exhaust gas outlet open to the atmosphere;

(b) combustion chamber means positioned in at least a portion of the interior of said tank means so as to evenly heat the retained liquid volume;

(c) means in said combustion chamber for enabling fuel and air to be introduced into said combustion chamber and being ignited to create a downwardly emitting combustion flame, which produces a hot gas, wherein said flame does not touch the interior walls of said combustion chamber or the liquid;

(d) port means located in said combustion chamber means for enabling said hot gas to be passed from the interior of said combustion chamber into the liquid in said tank means below the surface level of the liquid in said tank means;

(e) liquid surface level control means for controlling said surface level of the liquid in said tank means so that heat is extracted from said hot gas by the liquid until the temperature of said hot gas, when it is withdrawn from the tank means through said exhaust gas outlet, as exhaust gas, is about the same temperature as the temperature of the liquid heated by said hot gas when it is withdrawn from said tank means through said liquid outlet, as hot liquid; and cold liquid is introduced into said tank means through said liquid inlet.

15. A submerged combustion system as claimed in claim 14 wherein a fixed height weir prevents said hot gas from exiting said tank means via said liquid outlet.

16. A submerged combustion system as claimed in claim 15 wherein said tank means is a first cylindrical vessel, having a first bottom, a first top, a first diameter, and a first vertically aligned longitudinal axis, and said combustion chamber is a second cylindrical vessel which has a second diameter less than said first diameter, and a second longitudinal axis coincident to said first longitudinal axis of said first cylindrical vessel.

17. A system as claimed in claim 16 wherein the liquid surface level in said first cylindrical vessel is maintained at a level above said first bottom but below said first top and a portion of said combustion chamber which extends above the liquid surface level is cooled by a cooling liquid which is introduced into a cooling chamber which encircles a top region of said combustion chamber, and from said cooling chamber said cooling liquid spills over the top outer edges of said cooling chamber and runs down outer walls of said combustion chamber until said cooling liquid reaches the surface level of the liquid being heated.

18. A system as claimed in claim 17 wherein said cooling liquid is introduced into said cooling chamber near the top region of said combustion chamber by a pipe which causes said cooling liquid to circulate in a vortex pattern around the top of said cooling chamber.

19. A system as claimed in claim 18 wherein the elevation of the exterior side of said cooling chamber can be adjusted relative to the elevation of said combustion chamber.

20. A system as claimed in claim 19 wherein a nozzle means for combining fuel and air for combustion is positioned in the top interior of said combustion chamber.

21. A system as claimed in claim 20 wherein said combustion chamber has a bottom with an inverted conical shape.

22. A system as claimed in claim 21 wherein a lower region of said combustion chamber, above said inverted conical bottom, has a plurality of circular ports distributed around the circumference at a first elevation, and a plurality of circular ports distributed around the circumference at a second elevation which is higher than the first elevation.

23. A system as claimed in claim 22 wherein said lower region of said combustion chamber has distributed around the circumference a plurality of circular ports which are located at an elevation higher than the elevation of said first ports and said second ports.

24. A system as claimed in claim 23 wherein said hot gas is generated in said combustion chamber and said hot gas is emitted through said circular ports and passes upwardly through the liquid in said tank means to thereby heat the liquid in said tank means, and said hot gas is exhausted from said tank means through said exhaust gas outlet means.

25. A system as claimed in claim 24 including a valve means which recycles a predetermined amount of said hot liquid to said tank means upstream of said weir to thereby regulate said liquid surface level in said tank means, according to relative temperatures of said hot liquid and said exhaust gas.

26. A system as claimed in claim 25 including a computer means which senses the temperature of said exhaust gases, and the temperature of said hot liquid being withdrawn from said tank means, and prompts said valve means to open when the temperature of said exhaust gases is higher than the temperature of said hot liquid being withdrawn from said tank means, and prompts said valve means to close when the temperature of said hot liquid being withdrawn is the same as the temperature of said exhaust gases.

27. A system as claimed in claim 26 including a thermocouple means for measuring the temperature of said exhaust gas and thermo-couple means for sensing the temperature of said hot liquid being withdrawn from said tank means and a transducer which controls said valve means.

28. A system as claimed in claim 14 wherein a minimum operating liquid level is set by a fixed height weir.

* * * * *